United States Patent [19]

Hardy et al.

[11] 3,973,627

[45]*Aug. 10, 1976

[54] WELLBORE GRAVEL PACK METHOD

[75] Inventors: William C. Hardy, Richardson; Edward F. Schultze, Dallas; John C. Shepard, Richardson, all of Tex.

[73] Assignee: Sun Oil Company (Delaware), Dallas, Tex.

[ * ] Notice: The portion of the term of this patent subsequent to May 28, 1991, has been disclaimed.

[22] Filed: Nov. 12, 1973

[21] Appl. No.: 415,451

Related U.S. Application Data

[62] Division of Ser. No. 189,856, Oct. 18, 1971, Pat. No. 3,800,875.

[52] U.S. Cl. ..... 166/276; 166/302

[51] Int. Cl.[2] ..... E21B 43/02

[58] Field of Search ..... 166/272, 278, 276, 288, 166/302

[56] References Cited

UNITED STATES PATENTS

| | | | |
|---|---|---|---|
| 2,298,129 | 10/1942 | Irons | 166/288 |
| 2,771,952 | 11/1956 | Simm | 166/276 |
| 3,259,188 | 7/1966 | O'Brien | 166/276 |
| 3,327,783 | 6/1967 | Ayers | 166/276 |
| 3,393,736 | 7/1968 | Goodwin | 166/276 |
| 3,547,192 | 12/1970 | Claridge | 166/272 |
| 3,548,942 | 12/1970 | Terry | 166/276 |
| 3,690,377 | 9/1972 | Knight | 166/288 |
| 3,812,913 | 5/1974 | Hardy et al. | 166/288 |

*Primary Examiner*—Ernest R. Purser
*Assistant Examiner*—Jack E. Ebel
*Attorney, Agent, or Firm*—J. Edward Hess; Donald R. Johnson; Macka L. Murrah

[57] ABSTRACT

Methods of gravel packing are disclosed utilizing controlled melting point materials with the gravel placed behind a liner located in the wellbore. The controlled melting point materials can be coated on the gravel prior to its placement behind the liner or circulated behind the liner separate from the gravel. After placement of the gravel and controlled melting point material behind the liner, heat is provided to melt the material so that it acts as a consolidating agent.

5 Claims, 2 Drawing Figures

WELLBORE GRAVEL PACK METHOD

This is a division of application Ser. No. 189,856, filed Oct. 18, 1971, now U.S. Pat. No. 3,800,875.

BACKGROUND OF THE INVENTION

This invention relates to a method of consolidating a gravel pack by use of controlled melting point materials and heat.

In many oil or gas bearing formations, as well as water sands, the particles comprising the formation are not effectively cemented together, which results in the formation either being substantially unconsolidated or only loosely consolidated. These formations are oridinarily comprised of sands or sandstone. When fluids are produced from such formations, solid particles from the formation flow into the wellbore. If these formation fluids in the unconsolidated formations are under high pressure, the solid particles will flow through the tubing and other equipment in the wellbore at high velocities, causing severe erosion of well equipment. If the flow rates are not at high velocities, the solid particles flow into the wellbore and plug the tubing. It is then necessary to perform expensive workover operations on the well to place it back in operation. In extreme cases, the unconsolidated oil-bearing formation surrounding the well is washed out, and undermines the overlying formations penetrated by the wellbore with the result that those formations sometimes collapse and damage the well.

Several methods have been used to combat the flow of sands into the wellbore from unconsolidated formations. One such method is to set a slotted liner in the borehole through the producing formation and produce formation fluids through the slots of the liner. Sometimes the setting of the slotted liner is combined with a gravel packing operation in which gravel is packed around the liner to provide support for the unconsolidated formation. Both of these methods have the shortcoming that sands in the incompetent formation are still free to move and therefore can plug the gravel pack or liner. Because the gravel pack is comprised of gravel that is not adhered together, the gravel is free to move to allow formation sand to work its way through the gravel pack to plug the liner. This is especially true when the formation pressure has diminished such that the well is placed on the pump. The pulsating suction caused by the up and down movement of the pump keeps the gravel in a turbulent state such that it is easy for a formation sand to penetrate through it. To prevent this, it has been suggested that particles in the gravel pack be treated by a resin which coats the gravel pack particles, followed by condensation or polymerization to bond the particles into a unitary mass. Care must be taken to insure preservation of the permeability of the gravel pack after the resin treatment. Special resins are often used which have a high shrinkage factor upon drying such that the shrinkage provides permeability of the gravel pack. Control of the condensation or polymerization of the resin is extremely difficult because of the remoteness of the operation.

Another method that has been suggested to stabilize unconsolidated formations is to displace into the formation a mixture of liquid plastic in a catalyst for setting the plastic. In theory, the mixture will coat the sand particles and the plastic will act as a bonding agent when set by the catalyst. The main problems with this procedure are the maintenance of a proper mixture of catalyst and plastic, and in addition, a critical time factor arises. These two problems are interrelated in that an improper mixture can cause an extremely long or an extremely short set up time. In addition, plastics not contacted by the catalysts will be unlikely to ever set up. Thus, the plastic will flow into the wellbore when the well is returned to production. When the liquid catalyst has been premixed with the plastic, there is a limited amount of time in which the mixture can be placed in the formation. If a delay occurs in placement of the mixture, the plastic will set up wherever it is located, thus a delay caused by such things as pump failures and line blockages may result in the catalyst setting up in the mixing chamber or the wellbore.

In lieu of injecting a mixture of plastic and catalyst into formation, attempts have been made to inject the plastic and the catalyst separately into the formation. This procedure obviates the problem of the plastic setting up prior to its entering into the formation. Another problem arises however, because of the difficulty of achieving a good mixture in the formation. A catalyst may not reach substantial portions of the plastic, resulting in a poor consolidation job. Such poor consolidation will often result in a totally unsatisfactory consolidation.

An additional method of stabilizing an unconsolidated formation comprises coking formation fluids by reverse burn in situ combustion process. In such a process, air used to support the combustion of the formation fluids is flowed countercurrent to the direction of the burn. This is ordinarily accomplished by injecting air through an injection well and providing heat at the production well. Once ignition occurs, the flame front will move toward the source of oxygen, i.e., the injection well. The characteristic of such a reverse burn in situ combustion process is that a residue of coke is left on the particles on the formation. This coke residue effectively bonds together the sand grains making up the formation. If often proves difficult to maintain permeability in the formation when coking is accomplished by reverse burn.

Because of the shortcomings of present sand control methods, it is an object of the present invention to provide improved methods of sand control.

SUMMARY OF THE INVENTION

With this and other objects in view, the present invention comprises consolidating a gravel pack by use of controlled melting point materials which act as bonding agents. When the gravel and the controlled melting point material are located behind a liner, heat is supplied by burning a fuel gas adjacent the gravel pack to slump the material, so that upon cooling, the material bonds the gravel together. An excess of fuel gas is flowed into the borehole in order that unburned gas can be used to assist in transferring heat to the controlled melting point material.

DESCRIPTION OF THE PREFERRED EMBODIMENTS

Figure 1:
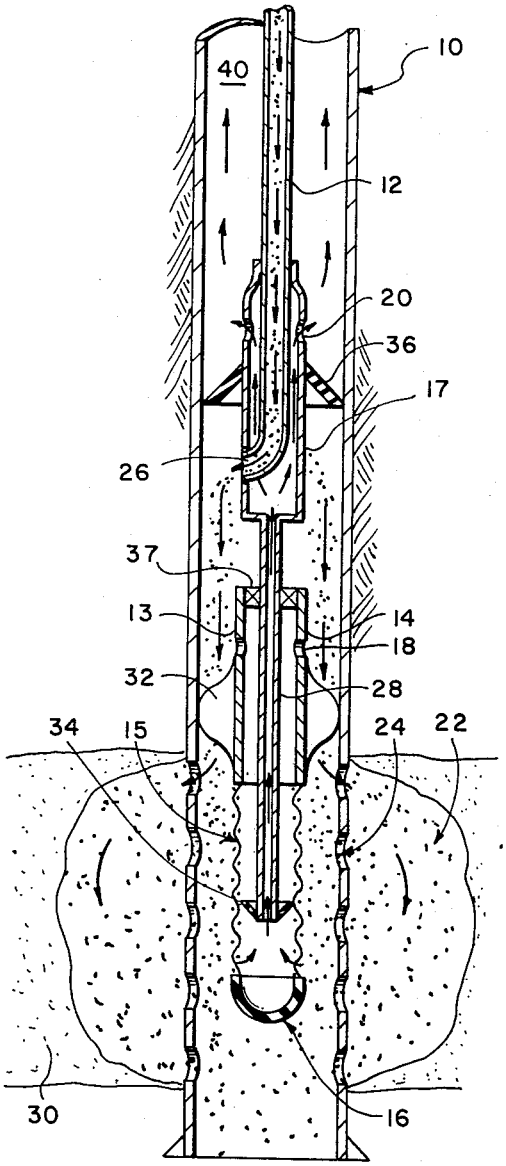
FIG. 1 is a sectional, elevational view of a wellbore being gravel packed with a cross-over tool.

Referring to FIG. 1, there is seen a formation 30 comprising unconsolidated sand which has been penetrated by a wellbore represented by casing 10 having perforations 24 therein. As illustrated, tubing 12 extending from the surface to a point adjacent the formation 30 to be consolidated, has attached thereto a cross-over tool 17. This cross-over tool comprises two independent flow channels one of which connects the annulus 40 between tubing 12 and casing 10 and the interior of liner 14. The other flow channel connects the interior of tubing 12 with the environment surrounding liner 14. Liner 14 comprises a pipe having a slotted portion 15 at its lower end above which there is blank pipe having tell-tale holes 18 therein. Cross-over tool 17 is connected with wash pipe 28 which extends down inside of liner 14, and terminates in the slotted portion 15 which is closed at its lower end by bull plug 16. Bull plug 16 is a heavy solid hemispherically shaped member for closing one end of the liner 14.

The liner 14 is maintained in the center of the wellbore by centralizers 32 which contact casing 10. Centralizers 32 are comprised of a multiplicity of spacially separated spacer elements, which prevent liner 14 from contacting casing 10. Liner 14 has sealing means 37 which prevents communication between the upper end of liner 14 and the exterior of said liner. This sealing means 36 provides such a closure by sealing the area between wash pipe 28 and the walls of liner 14. The sealing means 37 may be a packer which allows slidable movement of pipe therethrough and which can be released from engagement with the interior wall of liner 14 for removal therefrom.

The wash pipe 28 extends through the liner 14 and is spaced a short distance from the bull plug 16. An upward facing swap cup 34 is utilized on the lower end of the wash pipe 28 and prevents any liquids entering the upper portion of liner screen portion 15 from entering the interior of wash pipe 28 therein. This swab cup ordinarily consists of an annular piece of rubber mounted on a metal column. On the annular piece of rubber are resilient lips which are molded outward from the center piece of form a seal with the interior wall of a surrounding pipe interior. Cross-over tool 17 contains fluids return exit 20 located on the upper side of the tool. This fluids return exit communicates with the interior of wash pipe 28. Downwardly facing swab cups 36 preclude communication between the annulus 40 and the area adjacent the liner 14. This swab cup 36 is located immediately below fluids return exit 20. Tell-tale ports 18 are located in the blank liner section 13 of the liner 14 and are small perforations therein.

In the operation of the apparatus just described, gravel or coarse sand in a liquid solution is pumped down tubing 12 and into cross-tool 17, whereupon it is directed to the exterior of liner 14, as well as passing through perforations 24 and into formation 30 adjacent such perforations. The slotted portion 15 is sized such that it will not pass the gravel, but will pass the carrier liquid into the interior of the slotted portion 14 of liner 15. Such liquid will enter the lower portion of slotted portion 15 of liner 14 because of the upwardly facing swap cut located near the lower end of the slotted portion 15. The positioning of the upwardly facing swab cup 34 is also such as to direct the liquid and gravel slurry to the lower end of the liner 14 before it finds a return passage to the top of the wellbore. The liquid then passes up wash pipe and into cross-over tool 17, whereupon it is directed out fluids return exit 20 and into the annulus 40. The fluid then returns to the surface by way of the annular space 40. Gravel is continuously pumped down the tubing 12 until it fills the wellbore to a point above tell-tale ports 18. When the gravel reaches this point an increase in circulating pressure is exhibited. Gravel injection is then terminated and swab cup 34 may be reciprocated along the length of the screen 15 in order to break down any gravel bridges which have been formed which prevent a compact gravel pack. More gravel may then be added to fill areas left vacant by compacting the gravel. This process may be repeated until the gravel is compacted. Once sufficient gravel has been injected to homogeneously cover liner screen portion 15, the cross-over tool 17, wash pipe 28, and packer 37 may be removed from the wellbore.

At such time, a homogeneous gravel has been packed around the liner 14 and occupies an area of the formation 30 adjacent the perforations 24. This gravel may now operate as a filter medium. The purpose of such filter medium is to prevent sand from flowing through the perforations and then to the wellbore, while formation fluids pass through the gravel pack 22 and through screen portion 15 which will be connected to production tubing.

The method of positioning gravel behind a liner 14 forms no part of the invention. Therefore, any other well known gravel packing technique may be employed. One of such other methods is gravel packing by reverse circulation. In such a process the cross-over tool is not needed. A gravel and liquid slurry is pumped down the annulus of the wellbore and is left adjacent the perforations and screen while the liquid passes through the screen and up the wash pipe and tubing. This process has the disadvantages of being time consuming, sometimes sticking in the tubing, and scouring the casing wall which causes scale and debris to be packed around the screen.

Another gravel packing procedure is the wash down technique. Here only tubing is in the wellbore with a packer engaging the bottom of the tubing and the casing adjacent the perforations. The perforations are then washed to obtain a cavity behind the pipe and to assure that the perforations are open. After washing the perforations gravel is squeezed through the perforations with a carrying fluid until the cavity behind the pipe is filled and reserve gravel remains within the casing. A screen and liner is then washed into position opposite the perforations by direct circulation.

Figure 2:
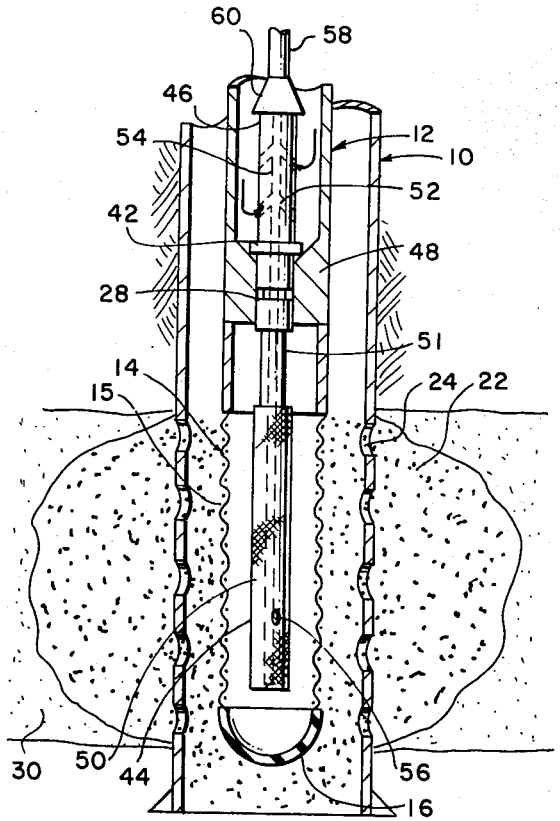
FIG. 2 is a sectional elevational view of a wellbore which has been gravel packed and a catalytic heater positioned adjacent the gravel pack.

Referring next to FIG. 2, there is seen a formation 30 comprising an unconsolidated sand which has been penetrated by a wellbore. The wellbore has casing 10 located therein having perforations 24 adjacent the unconsolidated formation 30. Gravel pack 22 is shown surrounding a liner 14 having a slotted liner section 15. The gravel pack also occupies an area formerly filled by unconsolidated formation 30 adjacent the perforations 24. This gravel pack could well have been created by the process described in FIG. 1. Positioned above the liner 14 is tubing 12 which has been run in on top of liner 14.

A seating nipple 48 is shown as being positioned at the lower end of tubing 12. This seating nipple is a flange restricting the tubing having a shoulder for engaging wellbore tools. Landed in seating nipple 48 is catalytic heater 50. The catalytic heater comprises a catalytic section 44, a landing flange 42, and a gas inlet section 46. Gas inlet section 46 has gas inlet ports 52 which communicate with gas distribution channel 54. Gas distribution channel 54 is a cylindrical bore running down through gas inlet section 46 and landing flange 42. Landing flange 42 has a flange portion for engaging the shoulder of seating nipple 48 and an O ring section for creating a seal between the landing flange 42 and the interior wall of seating nipple 48. Located below landing flange 42 is stand off member 51 which also has the gas distribution channel 54 passing therethrough. Stand off member 51 is blank pipe which spaces the catalytic section 44 from the landing flange 42 and seating nipple 48. The lowermost portion of the catalytic heater 50 is catalytic section 44 which comprises an oxidation catalyst such as platinum oxide on a support such as aluminum silicate. Positioned on the skin of the catalyst in catalytic section 44 is thermocouple 56. Thermocouple 56 connects with the surface by way of thermocouple cable 58 which is also used to run the catalytic heater 50 into the wellbore. Thermocouple cable 58 connects with catalytic heater 50 through hanger 60 which simply attaches the thermocouple cable 58 to the catalytic heater 50.

The apparatus just described in FIG. 2 is used in bonding together the gravel pack 22 so that it operates to more effectively control movement of unconsolidated sands into the wellbore. Once the gravel has been placed in position by the method described in FIG. 1 or a similar gravel pack method, a controlled melting point material which will act as a bonding agent after the application of heat, may be injected into the gravel pack. Alternatively, such bonding materials may be inorganic or organic. Inorganic compounds which may be used should have a melting point temperature below approximately 800°F. Above such temperature problems arise with regard to wellbore damage. Several inorganic compounds with acceptable melting point temperatures are glass which melts at 720°F., and zinc melting at 790°F. Among the organic bonding materials which can be used are such things as polyethylene or nylon.

If the gravel is placed behind the perforations prior to application of the bonding material a non-oxidizing gas is flowed into the formation to maintain permeability in the gravel while the bonding agent is placed in the area adjacent the perforations. The bonding agent may be pumped into the well in liquid form or in a granular or powdered form with a carrier liquid. The non-oxidizing gas is continuously pumped into the formation until such time as the bonding agent sets up.

In order to set the bonding agent, the catalytic heater 50 is run into the well and seated by landing flange 42 contacting seating nipple 48. A fuel gas such as methane is flowed down the annulus 40 while a stoiciometric amount of oxygen is flowed down the tubing interior 12. To initiate a reaction of the fuel mixture at the surface of catalytic section 44, hydrogen is included with the fuel gas, which will spontaneously react with air in the presence of a platinum group catalyst. Methane in excess of fuel requirements, or other inert gas, is flowed into the formation and acts as a heat carrying medium. When sufficient heat has been supplied to partially melt the solid materials, heating is terminated. Gas is still flowed into the formation to maintain permeability until the bonding material is completely set up.

The preferable way to bond the gravel pack is by coating the gravel with the bonding material prior to placement of the gravel adjacent the perforations. Once a coating of bonding material is placed on the gravel, it is placed in the well in the manner described in FIG. 1. A gas is flowed into the formation to maintain permeability and the heater 50 is located adjacent the perforations to partially melt the bonding material. After the bonding material has slumped, heating is terminated and the gravel pack is allowed to cool. As the bonding material dries it adheres to adjacent surfaces thereby creating a cohesive mass having permeability caused by the gas flow.

In the event the consolidation effort is not successful, the heater can be returned to the wellbore to melt the bonding material so that it can be removed. The process can then be repeated to reconsolidate the gravel pack.

While particular embodiments of the present invention have been shown and described, it is apparent that changes and modifications may be made without departing from this invention in its broader aspects, and therefore, the aim in the appended claims is to cover all such changes and modifications as fall within the true spirit and scope of this invention.

What is claimed is:

1. A process for gravel packing a well having an unconsolidated formation comprising: locating an aggregate in the wellbore and in the unconsolidated formation adjacent the wellbore; flowing a controlled melting point material into the area occupied by the aggregate; flowing an excess of fuel gas into the area occupied by the aggregate; burning a portion of the fuel gas to heat the area occupied by the aggregate to a temperature in excess of the melting point of the controlled melting point material, the excess of gas assisting in transferring heat to the controlled melting point material; and terminating the burning to allow the controlled melting point material to solidify.

2. The process of claim 1 including continuing to flow the fuel gas through the aggregate after terminating burning to maintain permeability.

3. The process of claim 1 wherein the controlled melting point material has a melting point less than 800°F.

4. The process of claim 2 wherein the controlled melting point material is selected from the group consisting of plastics, resins glass or zinc.

5. The process of claim 1 wherein the controlled melting point material is flowed into the wellbore in powdered form suspended in a liquid medium.

* * * * *